United States Patent [19]

Sato et al.

[11] Patent Number: 4,551,081

[45] Date of Patent: Nov. 5, 1985

[54] PULLEY MECHANISM FOR FLUID DISPLACEMENT APPARATUS

[75] Inventors: Tadashi Sato, Maebashi; Masaharu Hiraga, Honjo, both of Japan

[73] Assignee: Sanden Corporation, Gunma, Japan

[21] Appl. No.: 665,087

[22] Filed: Oct. 26, 1984

Related U.S. Application Data

[63] Continuation of Ser. No. 433,795, Oct. 12, 1982, abandoned.

[30] Foreign Application Priority Data

Oct. 12, 1981 [JP] Japan ..... 56-162212

[51] Int. Cl.[4] ..... F04C 18/02; F01C 1/02

[52] U.S. Cl. ..... 418/55

[58] Field of Search ..... 418/55, 59; 300/195; 29/280; 474/199, 198, 195

[56] References Cited

U.S. PATENT DOCUMENTS

| | | | |
|---|---|---|---|
| 801,182 | 10/1905 | Creux . | |
| 1,906,142 | 4/1933 | Ekelof . | |
| 3,178,964 | 4/1965 | Peras | 418/151 |
| 3,874,827 | 4/1975 | Young . | |
| 4,068,907 | 1/1978 | Zenthoefer | 474/199 |
| 4,314,796 | 2/1982 | Terauchi | 418/55 |
| 4,406,600 | 9/1983 | Terauchi et al. | 418/55 |

*Primary Examiner*—William R. Cline
*Assistant Examiner*—John J. McGlew, Jr.
*Attorney, Agent, or Firm*—Banner, Birch, McKie & Beckett

[57] ABSTRACT

A fluid displacement apparatus is disclosed. The apparatus includes a housing having a front end plate, a fixed member and an orbiting piston member. The fixed and orbiting piston members interfit to make a plurality of line contacts to define a sealed off fluid pocket. A driving mechanism, including a drive shaft, is disposed within the housing and is operatively connected to the orbiting piston member to effect the orbital motion of the orbital piston member by the rotation of the drive shaft. The drive shaft is rotatably supported by the front end plate through a bearing. An annular sleeve projecting axially from a front end surface of the front end plate surrounds the drive shaft. A pulley member is fixed on an axial end of the drive shaft which extends from the sleeve and is rotatably supported by the sleeve through a bearing on the outer surface of the sleeve. The drive shaft is thus rotatably supported by the front end plate through two bearings, one within the front end plate and the other on the outer surface of the sleeve.

3 Claims, 4 Drawing Figures

PULLEY MECHANISM FOR FLUID DISPLACEMENT APPARATUS

BACKGROUND OF THE INVENTION

This application is a continuation of Ser. No. 433,795, filed Oct. 12, 1982, now abandoned.

This invention relates to a fluid displacement apparatus, and more particular, to a fluid compressor or pump of the type which utilizes an orbiting piston.

There are several types of fluid displacement apparatus which utilize an orbiting piston or fluid displacement member driven by a Scotch yoke type shaft coupled to an end surface of the piston or member. U.S. Pat. No. 1,906,142 to John Ekelof discloses a rotary machine provided with an annular, eccentrically movable piston adapted to act within an annular cylinder having a radial transverse wall. One end wall of a chamber defined by the piston and cylinder is formed by a fixedly mounted wall of the cylinder, and the other wall of the chamber consists of a cover disc connected to the annular piston, which is driven by a crank shaft. Another prior art fluid displacement apparatus is shown in U.S. Pat. No. 801,182.

Though the present invention applies to either type of fluid displacement apparatus, i.e., using either an annular piston or a scroll type piston, the description will be limited to a scroll type compressor. The term piston is used herein generically to describe a movable member of any suitable configuration, i.e. an annular, scroll, etc., in a fluid displacement apparatus.

U.S. Pat. No. 801,182 discloses a device including two scroll members each having an end plate and a spiroidal or involute spiral element. These scroll members are maintained angularly and radially offset so that both spiral elements interfit to make a plurality of line contacts between spiral curved surfaces to thereby seal off and define at least one pair of fluid pockets. The relative orbital motion of the scroll members shifts the line contact along the spiral curved surfaces and therefore, the fluid pockets change in volume. The volume of the fluid pockets increases or decreases dependent on the direction of the orbital motion. Therefore, the scroll type fluid apparatus is applicable to compress, expand or pump fluids.

Typically a drive shaft receives and transmits a rotary driving force from an external power source. The drive shaft is rotatably supported by a bearing disposed within a housing. In particular, as shown in U.S. Pat. No. 3,874,827, the drive shaft is rotatably supported by two bearings located within the housing.

Referring to FIG. 1, such a prior art shaft supporting construction for a fluid displacement apparatus will be described. A drive shaft 13' is formed with a disk shaped rotor 131' at its inner end portion and is rotatably supported by a first bearing 19' disposed within a sleeve 17' projecting from a front end plate 11'. Disk shaped rotor 131' is also rotatably supported by a second bearing 16' disposed within an opening 111' of front end plate 11'. A crank pin or drive pin axially projects from an end surface of disk shaped rotor 131', and is radially offset from the center of drive shaft 13'. Drive pin is connected to an orbiting scroll for transmitting the orbital motion from the drive shaft 13' to the orbiting scroll. The orbiting scroll is connected to the rotation preventing device so that the orbiting scroll is driven in orbital motion by the rotation of drive shaft 13' without rotating itself. Furthermore, scroll type fluid displacement apparatus of this type is suited for use as a refrigerant compressor of an automobile air conditioner. Generally, the compressor is coupled to an electromagnetic clutch for transmitting the output of the engine to the drive shaft of the compressor. The magnetic clutch comprises a pulley 22', a magnetic coil 23' and an armature plate 24'. Pulley 22', which is usually rotated by the output of the engine, is rotatably supported by sleeve 17' through a bearing 27', attached to the outer surface of sleeve 17'. Magnetic coil 23' is mounted on the outer surface of sleeve 17' by a support plate, and armature plate 24' is elastically supported on the outer end portion of drive shaft 13'.

In this construction, as shown in FIG. 1, drive shaft 13', which includes disk shaped rotor 131', is generally supported by two bearings 16' and 19' which are axially spaced from one another. Bearing 19' is located within and on the outer end portion of sleeve 17'. The diameter of sleeve 17' therefore must be increased, resulting in an increase in the diameter of the pulley. Since sleeve 17' extends from an axial end surface of front end plate 11' and is cantilivered, it requires mechanical strength. Furthermore, because the tensile force of the belt which connects pulley 22' to the engine is transmitted to sleeve 17' through pulley 22' and bearing 27', the thickness of sleeve 17' has a lower limit below which it can not be made. Thus, the diameter of bearing 27' which supports the pulley 22' cannot be decreased, and the outer diameter of the compressor itself is thereby increased.

Since the diameter of pulley has a lower limit, the drive ratio is also limited, with the result that the apparatus cannot be driven at high rotational speeds.

SUMMARY OF THE INVENTION

It is a primary object of this invention to provide an improved fluid displacement apparatus which has inherently small diameter drive pulley.

It is another object of this invention to provide a fluid displacement apparatus wherein the radial and axial dimensions of apparatus are reduced.

It is still another object of this invention to provide a fluid displacement apparatus which can be used at high rotational speeds.

It is yet another object of this invention to provide a fluid displacement apparatus which accomplishes the above described objects, and is simple to construct and manufacture.

An orbiting piston type fluid displacement apparatus according to this invention includes a housing having a front end plate, and a fixed member fixedly disposed relative to the housing to accept and cooperate with an orbiting piston member to compress or pump fluid. The orbiting piston member is driven by a drive shaft which penetrates the front end plate and is rotatably supported thereby through a bearing disposed within the front end plate.

An annular sleeve portion projecting from the front end surface of front end plate surrounds the drive shaft. A pulley member is fixed to the outer end portion of the drive shaft which extend from the sleeve portion. The pulley member extends around the outer peripheral surface of the sleeve portion and a bearing is placed between the outer peripheral surface of the sleeve portion and the inner peripheral surface of the pulley member. The drive shaft is thus supported by the two bearings and the pulley member is rotatably supported by the bearing on the outer peripheral surface of the sleeve.

The bearing located between the outer peripheral surface of the sleeve portion and the inner peripheral surface of the pulley member function as a rotatably support for both the drive shaft and the pulley member.

Further objects, features and other aspects of this invention will be understood from the following detailed description of preferred embodiments of this invention referring to the annexed drawings.

DETAILED DESCRIPTION OF PREFERRED EMBODIMENTS

Figure 1:
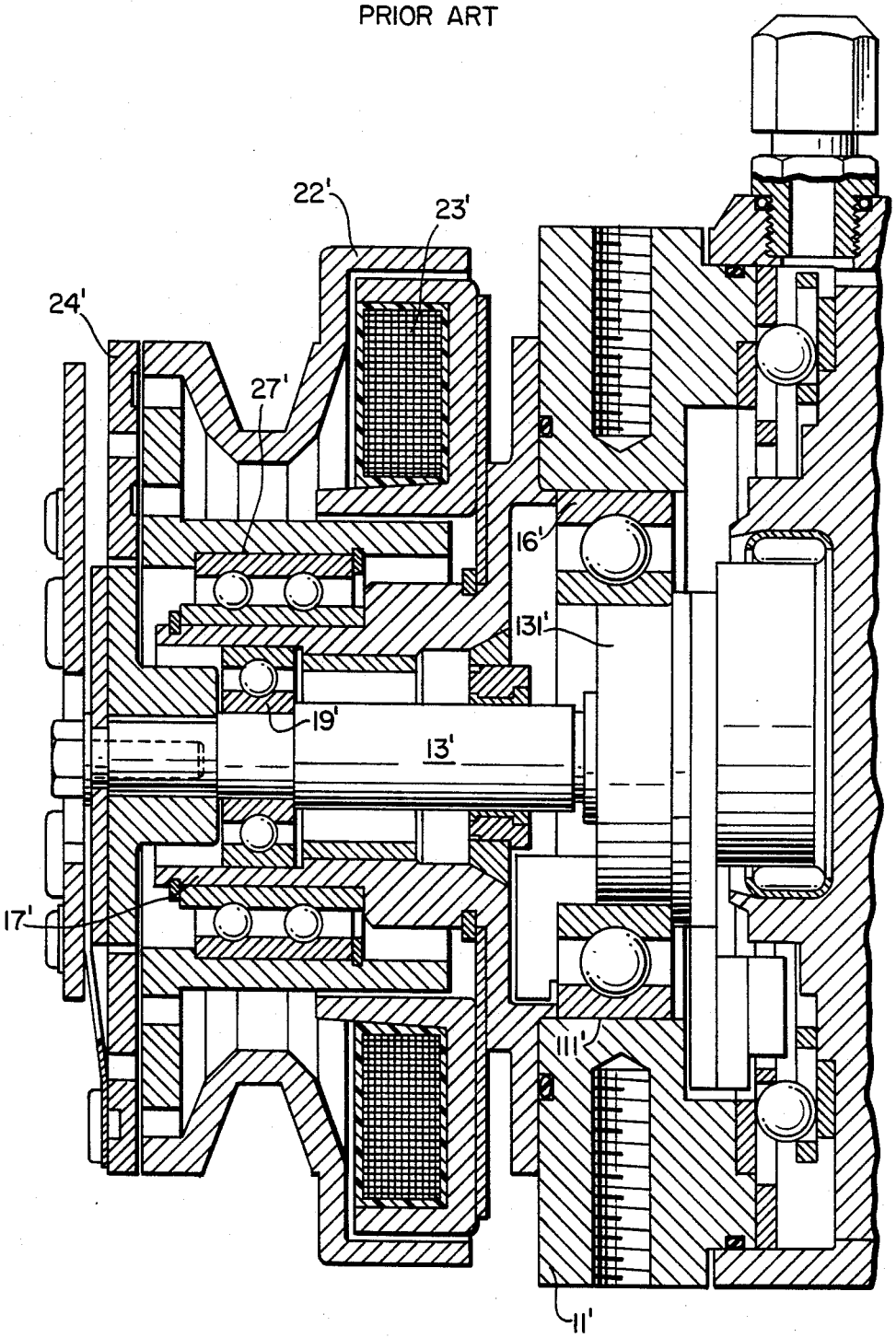
FIG. 1 PRIOR ART
FIG. 1 is a vertical sectional view of a main portion of a drive shaft supporting mechanism of a prior art fluid displacement apparatus.
Figure 2:
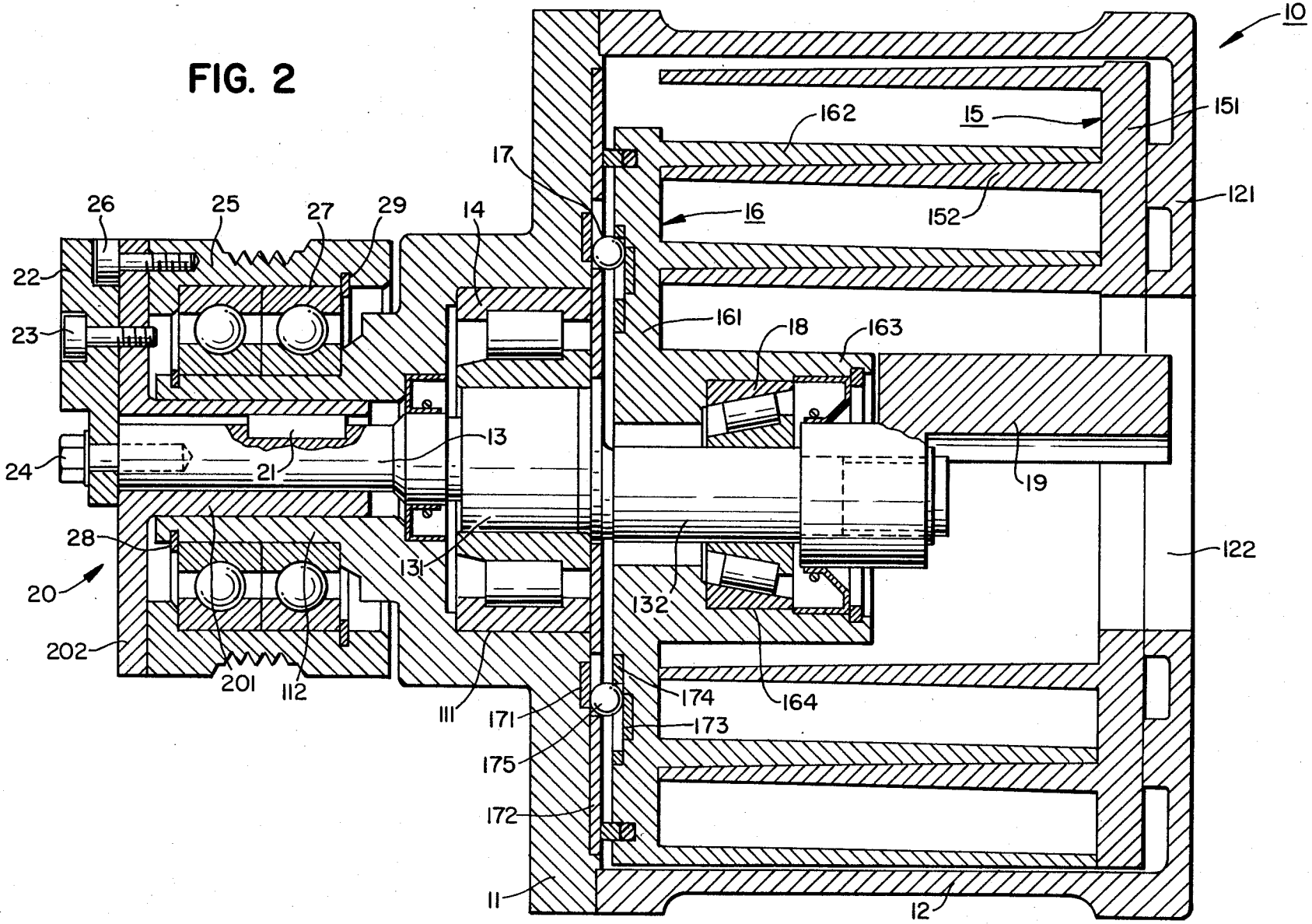
FIG. 2 is a vertical sectional view of a scroll type fluid displacement apparatus according to an embodiment of this invention.

Referring to FIG. 2, an embodiment of a fluid displacement apparatus in accordance with the present invention, in particular, a scroll type fluid displacement apparatus, is shown. The apparatus includes a housing 10 having a front end plate 11 and a cup shaped casing 12 fastened to one end surface of front end plate 11. The opening of cup shaped casing 12 is thus covered by front end plate 11.

An opening 111 is formed in the center of front end plate 11 for supporting a drive shaft 13. Drive shaft 13 has a disk shaped rotor 131 at its inner end portion which is rotatably supported by front end plate 11 through a bearing 14 located within opening 111 of front end plate 11. A drive pin or crank pin 132 projects axially from an axial end surface of disk shaped rotor 131 at a position which is radially offset from the center of drive shaft 13. Front end plate 11 has an annular sleeve 112 which projects from a front end surface thereof and surrounds drive shaft 13.

A number of elements are located within the inner chamber of cup shaped casing 12 including a fixed scroll 15, an orbiting scroll 16, and a rotation preventing/-thrust bearing device 17 for orbiting scroll 16. The inner chamber of cup shaped casing 12 is formed between the inner wall of cup shaped casing 12 and the rear end surface of front end plate 11.

Fixed scroll 15 includes a circular end plate 151 and a wrap or spiral element 152 affixed to or extending from one end surface of circular end plate 151. The end surface of circular end plate 151 on the side opposite from which spiral element 152 extends is attached against an inner end surface of end plate portion 121 of cup shaped casing 12. Orbiting scroll 16 includes a circular end plate 161, a wrap or spiral element 162 affixed to or extending from one end surface of circular end plate 161 and a tubular member 163 projecting axially from a generally central radial area of the side surface of end plate 161. Tubular member 163 extends axially a distance into the operative interior of cup shaped casing 12, and preferably to approximately the axial central area of spiral element 162, however, not beyond the axial end of spiral element 162. Both spiral elements 152 and 162 interfit at angular offset of 180° and predetermined radial offset. At least a pair of fluid pockets are thereby defined between spiral elements 152 and 162. Tubular member 163 has a hollow interior 164 extending through its center. Hollow interior 164 thus extends between the distal end of tubular member 163 at the axial central area of spiral elements 152, 162 and the side surface of end plate 161 opposite to the side thereof from which spiral element 162 extends.

A rotation preventing/thrust bearing device 17 is located between the inner end surface of front end plate 11 and an end surface of circular end plate 161 of orbiting scroll 16. Rotation preventing/thrust bearing device 17 includes a fixed race 171 attached to the inner end surface of front end plate 11, a fixed ring 172 attached to the inner end surface of front end plate 11 to cover the end surface of fixed race 171, an orbiting race 173 attached to the end surface of circular end plate 161, an orbiting ring 174 attached to the end surface of circular end plate 161 to cover orbiting race 173, and a plurality of bearing elements, such as spherical balls 175. A plurality of holes or pockets are formed through both rings 172 and 174 and each ball 175 is placed in facing, generally aligned pockets. The rotation of orbiting scroll 16 is prevented by the interaction between balls 175 and rings 172, 174; and the axial thrust load from orbiting scroll 16 is supported by front end plate 11 through balls 175.

Drive pin 132, which projects axially from the axial end surface of disk shaped rotor 131, is carried in hollow interior 164 of tubular member 163 by a bearing 18. Drive pin 132 has an axial length which extends from its connection point with disc shaped rotor 131, through hollow interior 164, and out of tubular member 163. The outer end portion of drive pin 132, which extends outward from tubular member 163, is provided with a balance weight 19 to cancel the centrifugal force which arises because of the orbital motion of orbiting scroll 16.

A rotation transmitting member 20 comprises a sleeve element 201 and a radial flange element 202. Sleeve element 201 surrounds drive shaft 13 and radial flange element 202 radially projects from the outer end portion of sleeve element 201. Radial flange element 202 is fixed on drive shaft 13 by a key 21. A balance weight 22 is fixed to an end surface of radial flange element 202 and to the end portion of drive shaft 13 by bolts 23 and 24. A pulley member 25 is fixed to the outer peripheral end surface of flange element 202 by a plurality of bolts 26, one of which is shown by FIG. 2, and extends axially from the forwardly facing surface of flange element 202 to surround sleeve 112. Pulley member 25 is rotatably supported by sleeve 112 through a bearing 27 secured on the outer surface of sleeve 112. Bearing 27 not only rotatably supports pulley member 25 but also rotatably supports drive shaft 13. Axial movement of bearing 27 is prevented by two snap rings 28, 29 and shoulder portions formed on the outer surface of sleeve 112 and on the inner surface of pulley member 25. Snap ring 28 is secured on the outer surface of sleeve 112, and snap ring 29 is secured to the inner wall of pulley member 25. The combination of rotation transmitting member 20 and pulley member 25 form a rotor member having the general configuration of a hollow annular cylinder with spaced inner and outer walls, and one closed axial end. Sleeve 112 and bearing 27 are received in this hollow annular cylinder and shaft 16 extends through a central open space inward of the inner wall defined by sleeve element 201.

Drive shaft 13 is provided with a pair of balance weights 19 and 22 to minimize the problems which would arise from the centrifugal force caused by the orbital motion of the orbital moving parts, such as orbiting scroll 16 and bearing 18. Balance weight 19 is placed on the outer end portion of drive pin 132 which extends from tubular member 163 of orbiting scroll 16, and causes a centrifugal force in opposite direction to the centrifugal force of the orbital moving parts when drive shaft 13 is rotated. Balance weight 22 is placed on the outer end portion of drive shaft 13 which extends from sleeve 112, and causes a centrifugal force in the same direction as the centrifugal force of balance weight 19 when drive shaft 13 is rotated.

Scroll type fluid displacement apparatus operates in the following manner. Pulley member 25 transmits rotation to drive shaft 13, which in turn orbits or revolves drive pin 132. Orbiting scroll 16 is connected to drive pin 132, and, therefore, is also driven in orbital motion. The rotation of orbiting scroll 16 is prevented by rotation preventing/thrust bearing device 17. As orbiting scroll 16 orbits, line contacts shift between both spiral elements 152 and 162 along the surfaces of the spiral elements. The fluid, introduced into the inner chamber of cup shaped casing 12 through a inlet port (not shown), is taken into the fluid pockets defined between the spiral elements. The fluid in fluid pockets moves to the center from the external portion (or moves to external portion from the center) with the orbital motion of orbiting scroll 16. The fluid introduced into the inlet port is thereby discharged from an outlet port 122 formed in the center of end plate portion 121 of cup shaped casing 12 after compression in the fluid pockets, or vice versa in an expansion mode.

As mentioned above, drive shaft 13 is rotatably supported by front end plate 11 through two bearings 14, 27 which are axially spaced from one another. Therefore, drive shaft 13 is supported in a manner which prevents whirling. Furthermore, pulley member 25 is rotatably supported by a bearing 27 placed on the outer surface of the sleeve portion 112. Therefore the diameter of the pulley is reduced to thereby increase the rotation speed of drive shaft. The tensile force of the belt coupled to the pulley does not act directly on the drive shaft, but rather is carried by the bearing placed on the outer surface of the sleeve. The strength of the drive shaft is thus enhanced.

Figure 3:
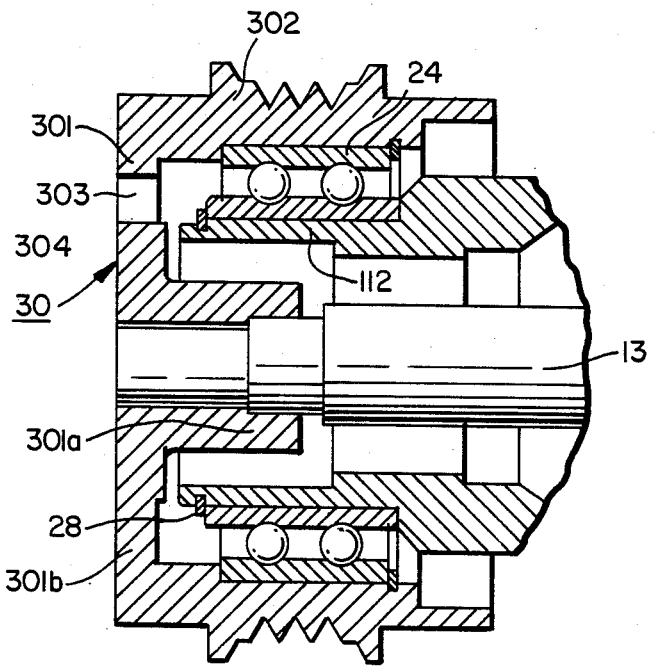
FIG. 3 is a vertical sectional view of a main portion of a drive shaft supporting mechanism according to another embodiment of this invention.
Figure 4:
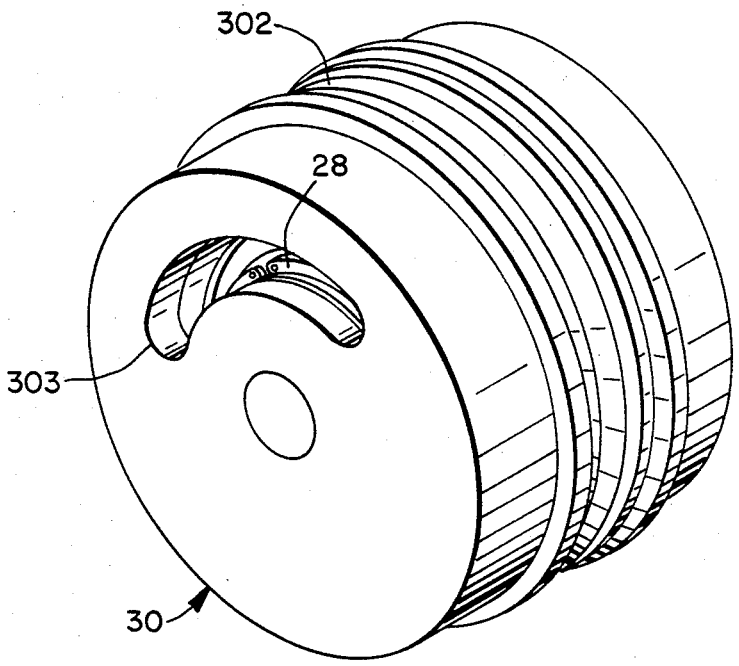
FIG. 4 is a perspective view of the rotor member illustrated in FIG. 3.

FIGS. 3 and 4 illustrate another embodiment of this invention with a modified rotation transmitting member and pulley member designed to improve the mechanical strength and reduce the axial dimension of the apparatus. In this embodiment, a rotor member 30 is formed of an integral rotation transmitting member 301 and pulley member 302. Rotation transmitting member 301 includes a tubular element **301*a* and a radial flange element 301*b*. Tubular element 301*a* is fixed on the outer end portion of drive shaft 13 by the friction fit of serrations and radial flange element 301*b* radially projects from the outer end portion of tubular element 301*a*. Pulley member 302 extends from the outer peripheral end surface of radial flange element 301*b* and is rotatably supported by sleeve 112 through a bearing 24 placed on the outer surface of sleeve 112**.

Since rotor member 30 is formed as a single integral member, provision is made to assist in fitting snap ring 28 onto sleeve 112. This is in contrast to the first embodiment wherein the parts of the rotor member could be disassembled to gain easy access to snap ring 28. Thus, an arc shaped hole 303 is formed through radial flange element **301*b* so that the fitting operation of ring 28 can be made therethrough. Also, the inner side surface of flange element 301*b* has an annular shoulder portion 304 onto which snap ring 28 can be placed prior to assembly. In addition to functioning as an access hole, hole 303 serves as an unbalance hole which makes rotor member 30 unbalanced. Rotor member 30** therefore can function as the second balance weight, without the need of an additional balance weight.

The invention has been described in detail in connection with preferred embodiments, but these are examples only and this invention is not restricted thereto. It will be easily understood by those skilled in the art that other variations and modifications can be easily made within the scope of this invention.

What is claimed is:

1. In an orbiting piston type fluid displacement apparatus including a housing having a front end plate, a fixed member fixedly disposed relative to said housing, an orbiting piston member disposed within said housing and interfitting with said fixed member to make a plurality of line contacts to define a sealed off fluid pocket, and a drive shaft penetrating said front end plate and being rotatably supported by said front end plate, the drive shaft being connected to said orbiting piston member to effect orbital motion of said orbiting piston member, the improvement comprising said front end plate being formed with an annular sleeve extending from a front end surface of said front end plate for surrounding said drive shaft, a first bearing carried by said front end plate for rotatably supporting said drive shaft, a rotor member including a pulley element, a tubular element and a radial flange element, and a second bearing carried on the outer surface of said sleeve and within the inner surface of said pulley element for rotatably supporting said drive shaft, said pulley element extending over and being rotatably supported by said second bearing, said tubular element being fixed on the outer end of said drive shaft, and said radial flange element radially projecting from an axial end of said tubular element and connected to said pulley element at its outer peripheral end surface, said rotor member being held in axial position by a first snap ring connected to an outer surface of said sleeve, a second snap ring connected to an inner surface of said pulley element, a first shoulder formed on the outer surface of said sleeve, and a second shoulder formed on the inner surface of said pulley element, said pulley, tubular and radial flange elements of said rotor member being formed integral with one another, and combined unbalance and access means for both unbalancing said rotor member and for providing access through said rotor member to one of said snap rings to accomplish the fitting operation of said last-mentioned snap ring, said combined unbalance and access means being an arc shaped hole formed completely through said radial flange element into the area between the outer surface of said sleeve and the inner surface of said pulley element, and extending over only a portion of said radial flange element to make said rotor member unbalanced.

2. The orbiting piston type fluid displacement apparatus of claim 1 further comprising a first balance weight, attached to the outer end of a crank pin coupling said drive shaft to said orbiting piston member, and a second balance weight attached to said radial flange element to cancel the dynamic unbalance caused by the centrifugal force of the orbital moving parts.

3. The orbiting piston type fluid displacement apparatus of claim 1 wherein the inner end surface of said radial flange element includes a shoulder portion facing said sleeve for carrying said last-mentioned snap ring prior to its placement on said sleeve.

* * * * *